US007903958B2

(12) United States Patent
Tsai

(10) Patent No.: US 7,903,958 B2
(45) Date of Patent: Mar. 8, 2011

(54) HANGING WATER HEATER

(76) Inventor: Hua-Hsin Tsai, Yunlin County (TW)

( * ) Notice: Subject to any disclaimer, the term of this patent is extended or adjusted under 35 U.S.C. 154(b) by 759 days.

(21) Appl. No.: 11/850,188

(22) Filed: Sep. 5, 2007

(65) Prior Publication Data

US 2009/0060482 A1 Mar. 5, 2009

(51) Int. Cl.
*F24H 1/10* (2006.01)
*F16L 53/00* (2006.01)

(52) U.S. Cl. ..... 392/485; 137/340

(58) Field of Classification Search ..... 392/301–497; 137/340, 341; 138/32, 33, 34, 35
See application file for complete search history.

(56) References Cited

U.S. PATENT DOCUMENTS 5,954,094 A * 9/1999 Base ..... 138/89
6,795,644 B2 * 9/2004 Bradenbaugh ..... 392/463
7,639,931 B2 * 12/2009 Tsai ..... 392/451
2008/0046111 A1 * 2/2008 Kataoka et al. ..... 700/207
2009/0250017 A1 * 10/2009 Akkala et al. ..... 122/14.2
* cited by examiner

*Primary Examiner* — Daniel Robinson
(74) *Attorney, Agent, or Firm* — Rosenberg, Klein & Lee

(57) ABSTRACT

A hanging water heater includes a machine body installed inside with plural quartz heating tubes respectively composed of a quartz external tube having its opposite ends sealed, and a quartz internal tube positioned in the quartz external tube, installed therein with a remote-infrared-ray heating member and having one end connected with an electrode terminal. Each quartz external tube has its lower sidewall bored with water intakes and its upper wall bored with a vapor vent. The machine body is further provided with a water inlet and a water outlet communicating with a circulating tube. The circulating tube communicates with the vapor vent of the quartz external tube, having its wall bored with lots of through holes. The hanging water heater performs heat conduction by vapor, and light and heat radiation, impossible to produce water stains and able to economize energy.

5 Claims, 3 Drawing Sheets

HANGING WATER HEATER

BACKGROUND OF THE INVENTION

1. Field of the Invention

This invention relates to a hanging water heater, particularly to one having a machine body installed therein with lots of quartz heating tubes with water inlets and vapor outlets for carrying out heat conduction by vapor, and by light and heat radiation, impossible to produce water stains and able to economize energy source.

2. Description of the Prior Art

Generally, people are used to taking a bath with hot water in a cold winter to wash off dirt of the body and refresh themselves.

Conventional water heaters are classified into electric water heaters and gas water heaters, but most families prefer using electric water heaters instead of gas water heaters for the sake of safety because gas water heaters are likely to produce carbon monoxide and cause an accident of toxicosis.

The conventional water heater is provided with heating members in the interior of a metal casing to be electrically connected for producing heat energy to be conducted by metal conductors for heating water; however, the metal conductors are most likely to produce water dirt on the surfaces to influence effect of heat conduction, thus wasting electric energy and shortening service life of a water heater.

SUMMARY OF THE INVENTION

The objective of this invention is to offer a hanging water heater provided with a machine body having its internal wall disposed with a heat-preserving double layer. The machine body has its upper and lower portion respectively and correspondingly fixed with a plurality of assembling bases. Plural quartz heating tubes are respectively installed between two corresponding assembly bases, respectively composed of a quartz external tube having its opposite ends sealed, and a quartz internal tube positioned in the quartz external tube, having one end connected with an electrode terminal and installed inside with a remote-infrared-ray heating member. In addition, each quartz external tube has its lower wall bored with water intakes and its upper wall bored with vapor vents. The machine body is further provided with a water inlet and a water outlet that communicates with a circulating tube in the machine body. The circulating tube communicates with the vapor vent of the quartz external tube, having its wall bored with lots of through holes to let vapor in the circulating tube to flow back to the interior of the machine body. Further, the machine body is bored with an exhaust vent assembled thereon with a pressure release valve communicating with the exhaust vent for releasing excessive pressure from the machine body to avoid causing an accident. The hanging water heater of this invention carries out heat conduction by means of vapor, and light and heat radiation, impossible to produce water stains and able to economize energy.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
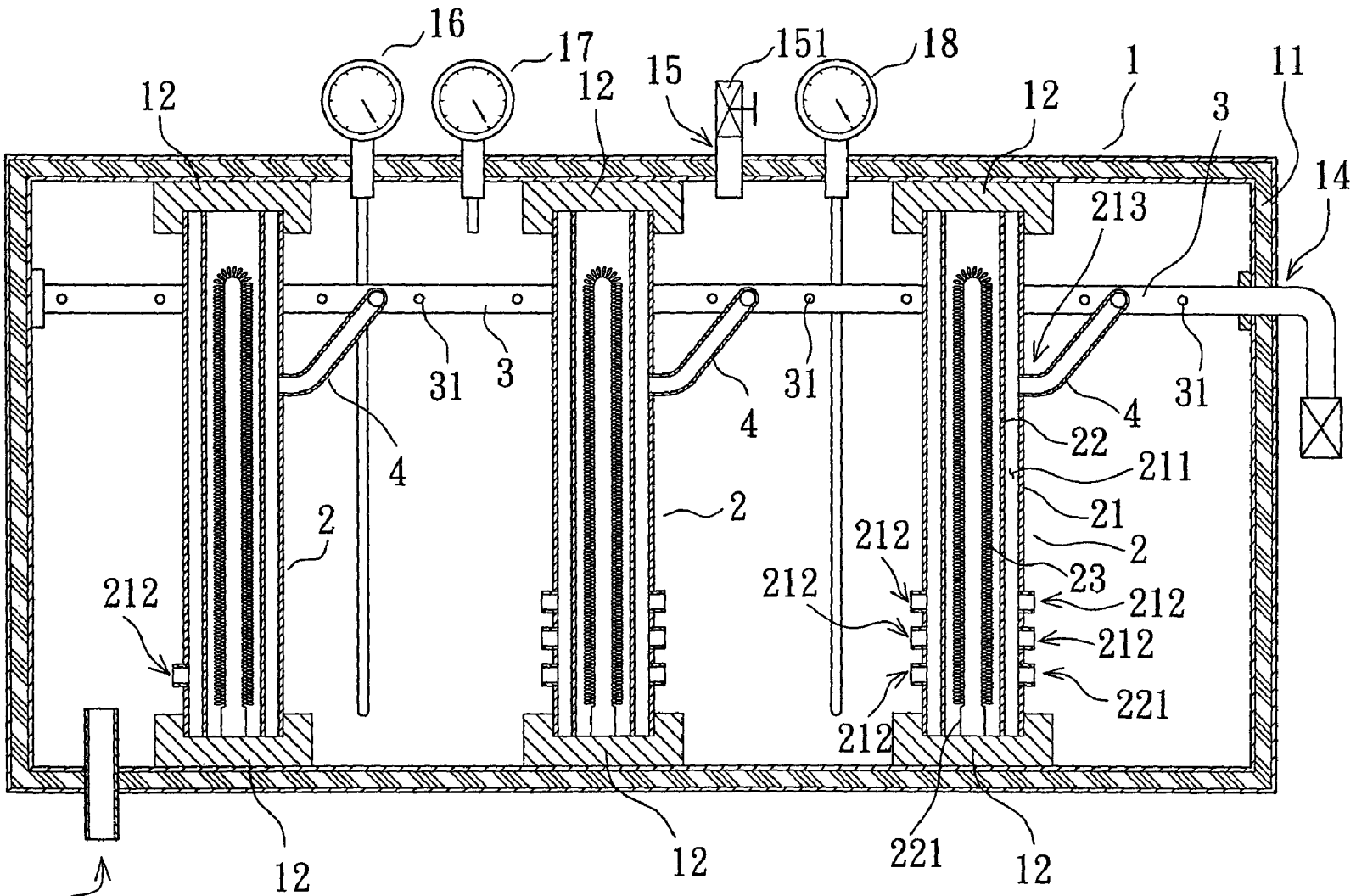
FIG. 1 is a side cross-sectional view of a hanging water heater in the present invention.

A preferred embodiment of a hanging water heater in the present invention, as shown in FIG. 1, includes a machine body 1, a plurality of quartz heating tubes 2 and a circulating tube 3 as main components combined together.

The machine body 1 has its external wall provided with a heat-preserving sandwich layer 11, and its inner upper and lower side respectively and correspondingly fixed with a plurality of assembling bases 12.

The quartz heating tubes 2 are respectively installed between two corresponding assembly bases 12, respectively composed of a quartz external tube 21 having its opposite ends sealed, and a quartz internal tube 22 positioned in the quartz external tube 21 and provided therein with a remote-infrared-ray heating member 23 preferably made of carbon fiber. The quartz internal tube 22 had one end connected with an electrode terminal 221 to be electrically connected to let the remote-infrared-ray heating member 23 produce remote infrared rays and heat energy. The quartz external tube 21 has its opposite ends combined with the quartz internal tube 22 by thermal compression, letting the electrode terminal 221 of the quartz internal tube 22 extended out of the quartz external tube 21 and having an accommodating space 211 formed between the quartz external tube 21 and the quartz internal tube 22. Further, each quartz external tube 21 has its lower sidewall bored with plural water intakes 212 and its upper sidewall bored with plural vapor vents 213.

The machine body 1 is further provided with a water intake 13 connected with a water source for supplying cold water, and a water outlet 14 for hot water to flow out for use.

The circulating tube 3 is assembled inside the machine body 1, connected with the water outlet 14 and communicating with the vapor vents 213 of the quartz external tubes 21 by means of ducts 4. The circulating tube 3 has its sidewall bored with lots of through holes 31 for vapor in the circulating tube 3 to flow back to the interior of the machine body 1.

Furthermore, the machine body 1 has its upper side bored with an exhaust hole 15 provided thereon with a pressure valve 151 communicating with the exhaust hole 15 for releasing excessive pressure from the machine body 1 to avoid accidents caused by excessively high pressure. In addition, the machine body 1 is provided at its topside with a water level meter 16, a pressure meter 17 and a temperature meter 18 for facilitating inspection of water level, pressure and temperature inside the machine body 1. The hanging water heater of this invention can be automatically controlled to stop water from flowing into the machine body 1 when the water level is too high and controlled to stop carrying out heating when the temperature is excessively high.

Figure 2:
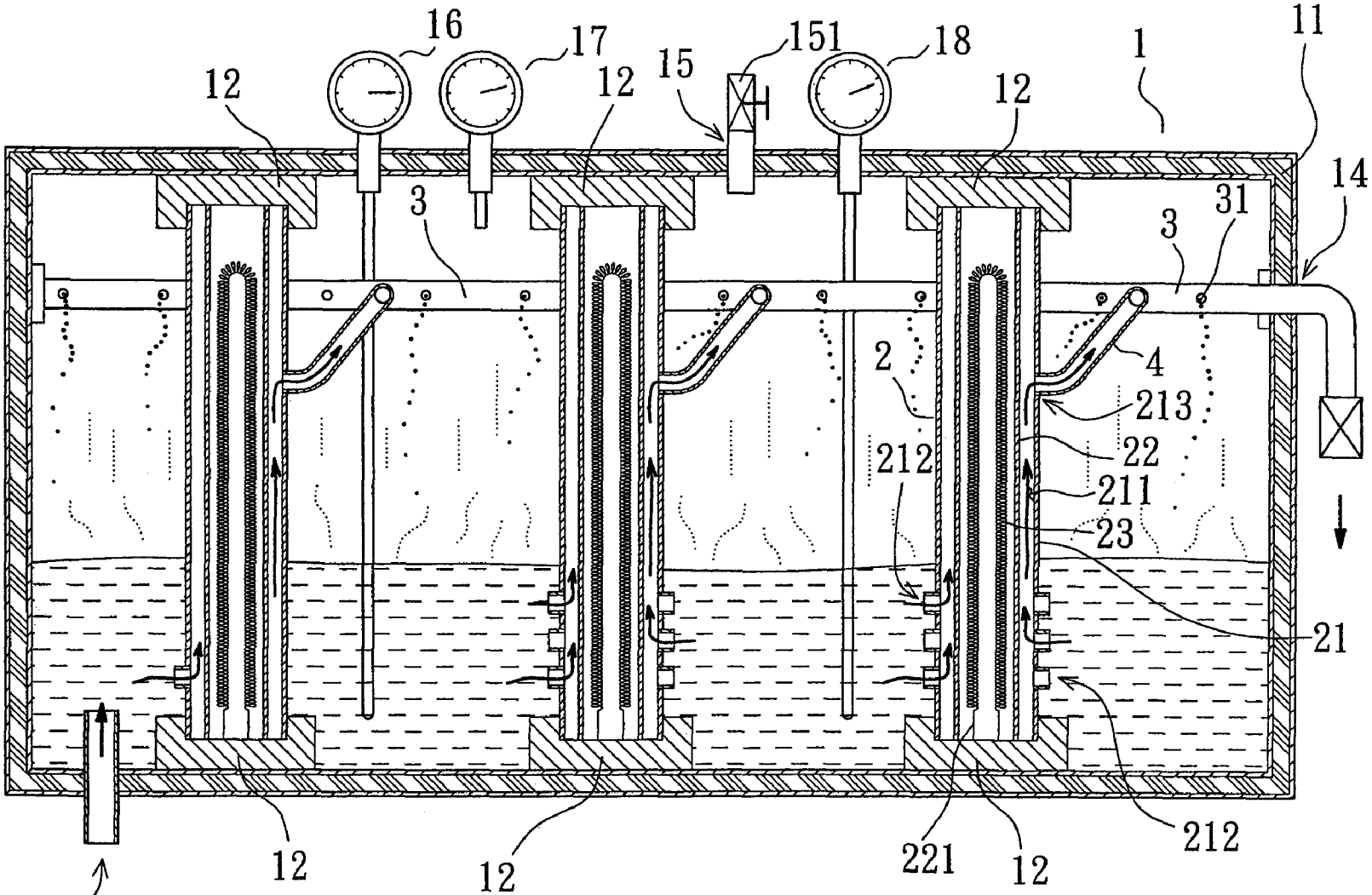
FIG. 2 is a side cross-sectional view of the hanging water heater in a using condition in the present invention.
Figure 3:
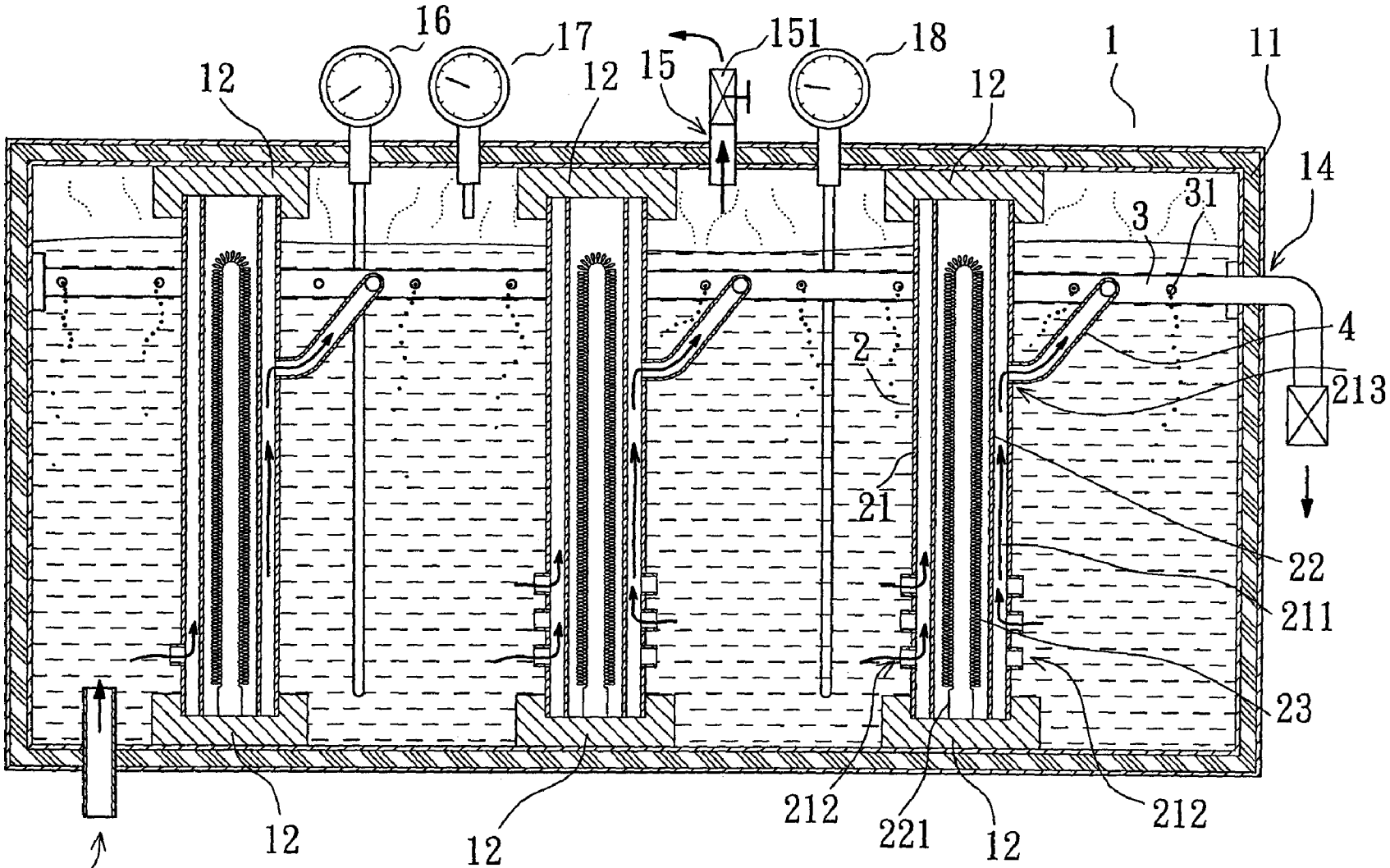
FIG. 3 is another side cross-sectional view of the hanging water heater in a using condition in the present invention.

In using, referring to FIGS. 2 and 3, cold water is first supplied to flow into the interior of the machine body 1 through the water intake 13 and, after the cold water flowing into the machine body 1 reaches a proper water level, it will flow into the accommodating space 211 between the quartz external tube 21 and the quartz internal tube 22 through the water intakes 212 bored in the lower walls of the quartz external tube 21. Since the quartz internal tubes 22 are respectively installed inside with a remote-infrared-ray heating member 23 able to produce light and heat radiation and heat energy with extremely high temperature; therefore, the water flowing in the accommodating spaces 211 will be quickly boiled and vaporized. Afterward, the boiled water will be exhausted out through the vapor vents 213 respectively bored at the upper walls of the quartz external tubes 21 and then flow into the circulating tube 3 through ducts 4. Simultaneously, the vapor in the circulating tube 3 will be exhausted out through the through holes 31 in the wall of the circulating tube 3 and get into the machine body 1; therefore, water temperature in the machine body 1 will rise quickly by heating of light and heat radiation and by hot water convection and especially by heating of boiling vapor, achieving effect of energy saving. Additionally, the water flowing into the accommodating space 211 between the quartz external tube 21 and the quartz internal tube 22 is heated, vaporized and heat conducted via light and heat radiation by means of the remote-infrared-ray heating members 23 so it is impossible to produce water stains. When hot water is to be used, only turn on the control valve of the water outlet 14 to enable hot water of condensed vapor in the circulating tube 3 to flow out, and at this time the vapor exhausted out through the vapor vents 213 of the quartz external tube 21 will heighten the pressure of the water vapor in the machine body 1 to let the hot water flow out for use more conveniently.

As can be understood from the above description, this invention has the following advantages.

1. The water inside the machine body can be heated to high temperature quickly via light and heat radiation produced by the remote-infrared-ray heating members and by convection of hot water as well as by heated vapor, able to quickly raise water temperature and greatly economize energy.
2. The water flowing in the accommodating space between the quartz external tube and the quartz internal tube is heated and vaporized by the remote-infrared-ray heating members inside the quartz internal tube and by heat conduction of vapor as well as by light-heat radiation, able to avoid producing water stains and prolong service life of the hanging water heater.
3. As mentioned above, the hanging water heater of this invention will never produce water stains to affect heat conduction, having excellent effect of energy saving.
4. The remote-infrared-ray hearting members inside the quartz internal tubes are heated to maintain extremely high temperature all the time; therefore the water flowing into the accommodating space between the quartz external tube and the quartz internal tube can be quickly boiled and vaporized. Afterward, such hot water and vapor will flow into the circulating tube through the vapor vents at the upper sidewall of the quartz external tubes and then be exhausted out through the through holes of the circulating tube and get into the machine body to heighten the pressure of water vapor inside the machine body, effectively increasing pressure for facilitating outflow of hot water.

While the preferred embodiment of the invention has been described above, it will be recognized and understood that various modifications may be made therein and the appended claims are intended to cover all such modifications that may fall within the spirit and scope of the invention.

What is claimed is:

1. A water heater comprising a machine body having an interior cavity with a top and a bottom, a plurality of quartz heating tubes being installed in said interior cavity, each of said quartz heating tubes having an upper end disposed adjacent to said top of said machine body and a lower end disposed adjacent to said bottom of said machine body, each of said quartz heating tubes having a lower wall portion adjacent said lower end thereof bored with water intakes and an upper wall portion adjacent said upper end thereof bored with vapor vents, each said quartz heating tube including at least a pair of quartz tubes, a first of said pair of quartz tubes having opposing ends of a bore thereof sealed, a second of said pair of quartz tubes being positioned within said bore of said first quartz tube, said second quartz tube a remote-infrared-ray heating member installed therein and connected with an electrode terminal, said machine body being provided with a water intake and a water outlet, said water outlet communicating with a circulating tube in said interior cavity of said machine body, said circulating tube communicating with said vapor vents of said plurality of quartz heating tubes by a plurality of ducts, said circulating tube having a wall thereof bored with a plurality of through holes, said machine body having an exhaust vent formed through a wall thereof, said exhaust vent having a pressure release valve in communication therewith.

2. The water heater as claimed in claim 1, wherein said machine body has a plurality of assembling bases correspondingly fixed on said top and bottom of said interior cavity, and each of said quartz heating tubes being respectively installed to extend between a respective correspondingly opposed pair of said assembling bases fixed on aid top and bottom of said interior cavity.

3. The water heater as claimed in claim 1, wherein said machine body has a water level meter assembled thereto.

4. The water heater as claimed in claim 1, wherein said machine body has a pressure meter assembled thereto.

5. The water heater as claimed in claim 1, wherein said machine body has a temperature meter assembled thereto.

* * * * *